US005429247A

United States Patent [19]

Lemay et al.

[11] Patent Number: 5,429,247

[45] Date of Patent: Jul. 4, 1995

[54] METHOD AND APPARATUS FOR SCREENING PEAT MOSS MATERIAL

[75] Inventors: Martin Lemay, Montreal; Serge Cadieux, Pierrefonds; Jacques Audet, Alma; Martin Roy, Anjou; John Dery, Montreal, all of Canada

[73] Assignee: Johnson & Johnson Inc., Montreal, Canada

[21] Appl. No.: 333,935

[22] Filed: Nov. 3, 1994

Related U.S. Application Data

[63] Continuation of Ser. No. 807,283, Dec. 13, 1991, abandoned.

[51] Int. Cl.[6] ..... B07B 9/00

[52] U.S. Cl. ..... 209/17; 209/235; 209/250; 209/268; 209/281

[58] Field of Search ..... 209/17, 268, 269, 273, 209/660, 674, 675, 208, 234, 235, 236, 240–242, 250, 261, 274, 275, 281

[56] References Cited

U.S. PATENT DOCUMENTS

| | | | |
|---|---|---|---|
| 1,198,404 | 9/1916 | Ballantine | 209/269 X |
| 2,317,430 | 4/1943 | Ayers et al. | 209/268 |
| 2,826,370 | 3/1958 | Weston | 209/268 X |
| 4,257,878 | 3/1981 | Fishback et al. | 209/17 X |
| 4,325,819 | 4/1982 | Altizer | 209/17 X |
| 4,437,982 | 3/1984 | Wasson | 209/17 X |

*Primary Examiner*—David H. Bollinger

[57] ABSTRACT

Method and apparatus for screening peat moss material. The method comprises the steps of forming an aqueous slurry of peat moss material and flowing the slurry on a screen to separate fines from coarser particles in the slurry. A spray of relatively large water drops is directed at the slurry to agitate the coarser particles blocked by the screen in order to dislodge fines adhering thereto, whereby the fines freed from the coarser particles are allowed to egress the slurry through the screen. The water spray also has the effect of clearing the screen of fines which clog the screen openings. The invention also comprehends a method and apparatus for screening peat moss material, comprising the steps of flowing an aqueous slurry of peat moss material on a sieve to extract from the slurry excessively large particles, and washing the rejects remaining on the sieve to dislodge therefrom smaller particles of acceptable size which are returned to the slurry.

25 Claims, 5 Drawing Sheets

METHOD AND APPARATUS FOR SCREENING PEAT MOSS MATERIAL

This is a continuation of application Ser. No. 07/807,283, filed Dec. 13, 1991, now abandoned.

FIELD OF THE INVENTION

The present invention relates to a method and apparatus for screening peat moss material to eliminate therefrom excessively large and/or excessively small particles. Advantageously, the method is used in the course of a process for classifying raw peat moss material in particulate form to obtain a slurry suitable for manufacturing absorbent cores for disposable absorbent products such as sanitary napkins, tampons, diapers, adult briefs, urinary pads wound dressings and the like.

BACKGROUND OF THE INVENTION

The prior art has recognized the potential of peat moss material for use as an absorbent medium in structures for absorbing body exudate. Peat moss material has highly desirable fluid absorption properties such as a remarkable absorption capacity and the ability of "drying" adjacent materials by continuing to pull or wick fluid away from them over a long time period such that virtually all the fluid is collected in the peat moss core. These attributes allow the material to provide highly efficient absorbent components which can be made relatively thin for better fit, comfort and discretion, while being sufficiently absorbent to prevent overflow leakage and garment staining.

The following United States Patents document the use of peat moss material for manufacturing absorbent components for disposable absorbent products:

| U.S. Pat. No. | INVENTOR | DATE ISSUED |
|---|---|---|
| 4,170,515 | Lalancette et al. | October 9, 1979 |
| 4,215,692 | Levesque | August 5, 1980 |
| 4,226,237 | Levesque | October 7, 1980 |
| 4,305,393 | Nguyen | December 15, 1981 |
| 4,473,440 | Ovans | September 25, 1984 |
| 4,507,122 | Levesque | March 26, 1985 |
| 4,618,496 | Brasseur | October 21, 1986 |
| 4,676,871 | Cadieux et al. | June 30, 1987 |
| 4,992,324 | Dubé | February 12, 1991 |
| 5,053,029 | Yang | October 1, 1991 |

The subject matter of these references is incorporated herein by reference.

Peat moss material can be formed in a highly cohesive board by any one of the methods disclosed in the above identified prior art. In a board form, the peat moss material is convenient to handle and it can be directly processed in high speed automatic equipment for assembling disposable absorbent products.

More particularly, the method for producing the peat moss board consists of classifying raw peat moos material in particulate form to retain only the particles which are the most absorbent. The screened fraction is sheeted on a Fourdrinier wire in the form of a slurry and dewatered by the application of vacuum. The thus formed board is dried and calendered to increase its density to the desired level. In order to tenderize, soften and improve the flexibility of the calendered peat moss board, it may be subjected to mechanical working such as perf-embossing and micro-corrugating as described in the U.S. Pat. Nos. 4,559,050 and 4,596,567 to Iskra, issued on Dec. 17, 1985 and Jun. 24, 1986 respectively.

The disclosure of these patents is incorporated herein by reference.

It is known in the art to classify peat moss material by forming an aqueous slurry of peat moss having a pumpable consistency and flowing the slurry on successive screens of increasing mesh size to eliminate from the slurry the fines and then the excessively large particles such as roots and branches. A major drawback of currently practised wet classification processes resides in the incomplete elimination of the fines from the slurry by the straining action of the screens. The cause of this problem is twofold. Firstly, the fines have the ability to adhere to coarser peat moss fragments which carry the fines through the various screening stages and into the final product. Secondly, the screen openings have a tendency to rapidly become clogged by fines and small fibers. As a result the screen becomes partially or totally inoperative.

Another drawback of prior art wet classification processes is the loss of a certain quantity of small absorbent particles from the slurry which have a tendency to adhere to oversize fragments in the slurry and are extracted and discarded with the oversize fragments during the screening stages. As a result, the peat moss raw material is utilized less efficiently which increases the manufacturing costs of the absorbent product.

OBJECTS OF THE INVENTION

An object of the present invention is a method and apparatus for screening peat moss material, permitting a larger fraction of fines to be eliminated by comparison to conventional screening processes.

Another object of the present invention is a method and apparatus for screening peat moss material permitting excessively large fragments to be eliminated such as roots and branches without loosing a significant quantity of smaller particles of acceptable size.

SUMMARY OF THE INVENTION

As embodied and broadly described herein, the invention provides a method for screening peat moss material in particulate form, comprising the steps of:

- forming a slurry of peat moss material having a pumpable consistency;
- depositing the slurry on a screen to separate fines from coarser particles in the slurry by straining action;
- directing a spray of fluid at the slurry while the slurry is on the screen to
  - i) agitate the coarser particles in order to dislodge fines adhered thereto, whereby fines free from the coarser particles are allowed to egress the slurry through the screen; and
  - ii) clear openings of the screen clogged by fines.

This screening method is highly advantageous because it allows to eliminate more completely the fines from the slurry by virtue of the cleansing action provided by the fluid spray which agitates the coarse particles blocked by the screen to dislodge fines adhering thereto, which are then returned in suspension in the slurry and eliminated through the screen. The cleansing action of the fluid spray also extends to the screen itself, allowing to clear the screen openings of fine particles clogging them. As a result, the screen is maintained in a fully operating condition.

In a preferred embodiment, an oscillating spray formed of large water drops having a size in the range from about 1200 microns to about 2500 microns is used for agitating the solid particles in the slurry and washing the screen. The oscillatory movement permits to reach various sections of the screen to achieve a more uniform treatment, by comparison to a stationary spray directed only at one section of the screen. A spray of large water drops is advantageous because large size drops vigorously agitate the slurry mass to dislodge fines therefrom and create a strong impact against the screen to clear the screen openings. Advantageously, the fluid spray is oscillated in a direction generally parallel to the direction of flow of the slurry on the screen. It has been observed that such movement enhances the removal of fines by disturbing the flow of slurry to create further agitation, especially when the spray moves countercurrent to the slurry flow.

The relationship between the flow rate of the fluid spray directed at the screen and the slurry flow rate on the screen is important to achieve optimum results. In a preferred embodiment, the spray has a flow rate in the range from about 18 to about 23.3 liters per minute per kilogram of bone dry solid material in the slurry entering the screen per minute. More preferably, the spray flow rate is of approximately 18 liters per minute per kilogram of bone dry solid material in the slurry entering the screen per minute. A flow rate at the lower end of the range is preferred to reduce as much as possible the amount of fluid that must be pumped and circulated through the screening system.

Advantageously, the method for screening peat moss material in accordance with the invention may be expanded to extract not only fines from the slurry but also excessively large fragments by performing a further screening step which consists of passing the slurry through a sieve dimensioned to retain the particles whose size exceeds a predetermined value. Preferably, the sieve is vibrated to facilitate the straining action by dispersing flocs that may form on its surface and by spreading uniformly the material delivered on the sieve. In addition, a water spray is directed to the sieve in order to agitate and wash rejects to dislodge therefrom smaller, acceptable particles which are returned in suspension in the slurry. This step reduces the amount of acceptable particles that are lost by adhering to the rejects and discarded therewith. In this manner, the raw material is utilized more efficiently.

Preferably, the slurry, at the outlet of the sieve, is directed toward a secondary screen which further refines the slurry by extracting residual fines. The secondary screen is also provided with a water spraying unit to augment the efficiency of the last screening stage.

As embodied and broadly described herein, the invention provides a method for screening peat moss material, comprising the steps of:

forming a slurry of peat moss material having a pumpable consistency;

depositing the slurry on a sieve to eliminate from the slurry particles larger than a predetermined acceptable dimension;

directing a fluid spray at the slurry while the slurry is on the sieve in order to dislodge from rejects blocked by the sieve acceptable particles adhering to the rejects and having a size less than the predetermined acceptable dimension, whereby acceptable particles freed from the rejects are returned in suspension in the slurry and are allowed to pass through the sieve.

As embodied and broadly described herein, the invention provides a method for classifying peat moss material in particulate form, the method comprising the steps of:

forming an aqueous slurry of peat moss material having a consistency in the range from about 0.40 to about 1.2% solids;

flowing the slurry over a screen having a mesh size in the range from about 40 to about 100 in order to separate fines from coarser particles in the slurry by straining action;

directing at the slurry a spray of relatively large water drops while the slurry is on the screen to:

i) agitate the coarser particles in order to dislodge fines adhered thereto, whereby fines freed from the coarser particles are allowed to egress the slurry through the screen; and ii) clear openings of the screen clogged fines;

collecting the slurry from an outlet of the screen;

flowing the slurry over a sieve having a mesh size in the range from about 8 to about 14 to eliminate from the slurry oversize particles having a dimension in excess of a predetermined value;

washing rejects blocked by the sieve with a spray of relatively large water drops to dislodge from the rejects acceptable particles adhering to the rejects and having a size such that the acceptable particles are capable of passing through the sieve, whereby acceptable particles freed from the rejects are returned in suspension in the slurry and are allowed to pass through the sieve.

As embodied and broadly described herein, the invention provides an apparatus for screening peat moss material, comprising:

a screen having a predetermined mesh size;

a supply conduit for delivering to the screen a slurry of peat moss material having a pumpable consistency, wherein the screen allows to separate fines from coarser particles in the slurry by straining action;

a spray head in fluid communication with a pressurized supply of fluid for generating a fluid spray directed at the slurry while the slurry is on the screen to;

i) agitate the coarser particles in order to dislodge fines adhered thereto, whereby fines freed from the coarser particles are allowed to egress the slurry through the screen; and ii) clear openings of the screen clogged by fines.

As embodied and broadly described herein, the invention provides an apparatus for screening peat moss material, comprising:

a sieve having a predetermined mesh size;

a supply conduit for delivering to the sieve a slurry of peat moss material having a pumpable consistency, wherein the sieve retains from the slurry particles having a size in excess of a predetermined value;

a reject washing device including a spray head in fluid communication with a pressurized supply of water for directing a spray of relatively large water drops at rejects on the screen to agitate and wash the rejects to dislodge acceptable particles having a size less than the predetermined value adhered to the rejects, whereby dislodged acceptable particles are returned in suspension in the slurry and are allowed to pass through the sieve.

As embodied and broadly described herein, the invention provides an apparatus for classifying peat moss material in particulate form, the apparatus comprising:

a screen having a mesh size in the range from about 40 to about 100;

a conduit for delivering a slurry of peat moss material to the screen, whereby the screen separates fines from coarser particles in the slurry by training action;

a spray head in fluid communication with a source of pressurized water for generating a spray of relatively large water drops directed at the slurry while the slurry is on the screen to:

i) agitate the coarser particles in order to dislodge fines adhered thereto, whereby fines freed from the coarser particles are allowed to egress the slurry through the screen; and ii) clear openings of the screen clogged by fines;

a sieve remote from the screen having a mesh size in the range from about 8 to about 14;

a conduit collecting the slurry from an outlet of the screen and transferring the slurry to the sieve, whereby the sieve retain from the slurry oversize particles;

a reject washing device including a spray head over the sieve in fluid communication with a source of pressurized water to generate a spray of relatively large water drops directed at the sieve to dislodge from rejects blocked by the sieve acceptable particles adhering thereto and having a size such that the acceptable particles are capable of passing through the sieve, whereby acceptable particles dislodged from the rejects are returned in suspension in the slurry and are allowed to pass through the sieve.

DESCRIPTION OF A PREFERRED EMBODIMENT

Figure 1:
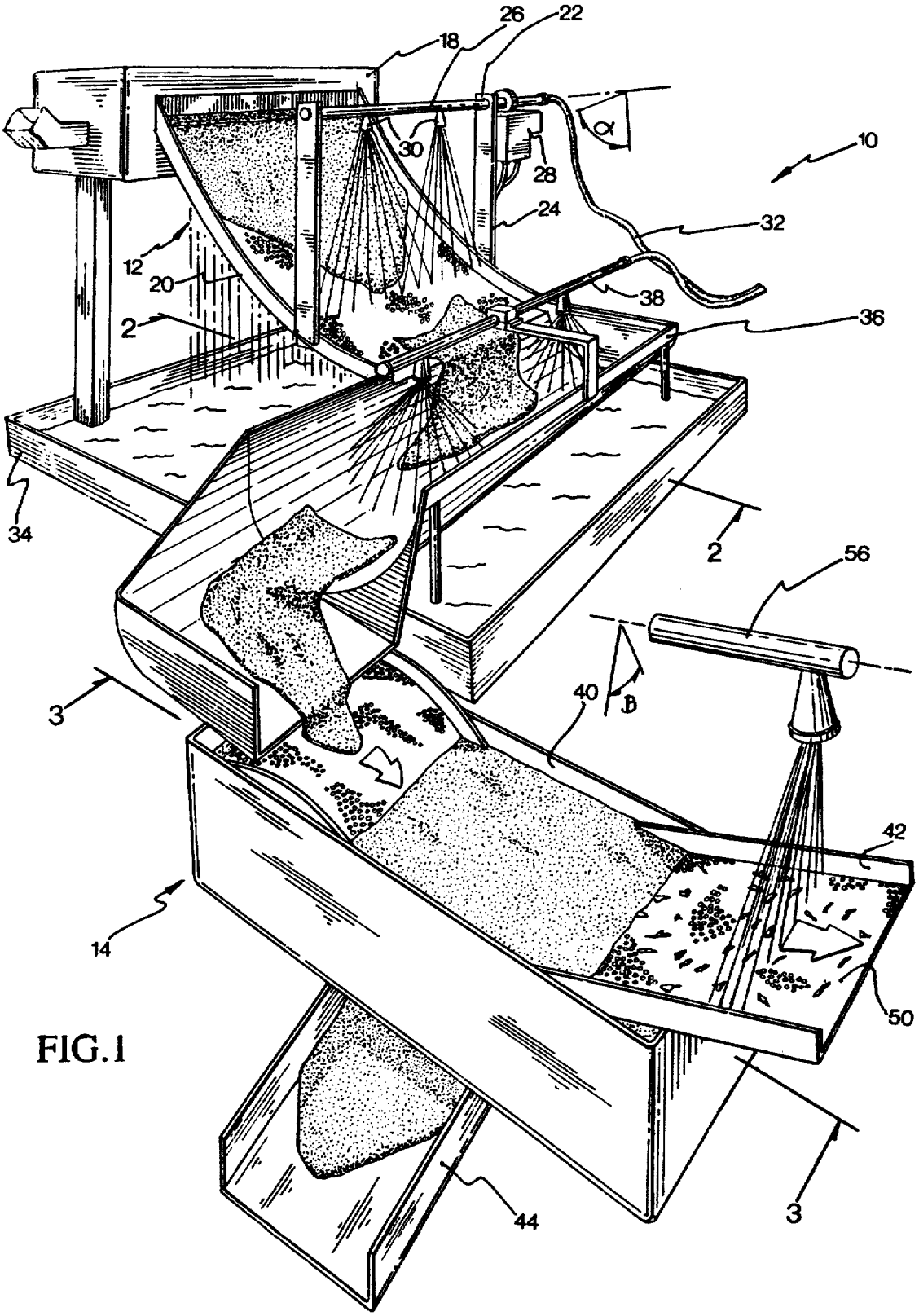
FIG. 1 is a schematical, perspective view of two screening stages of an apparatus for classifying peat moss material in accordance with the present invention.
Figure 2:
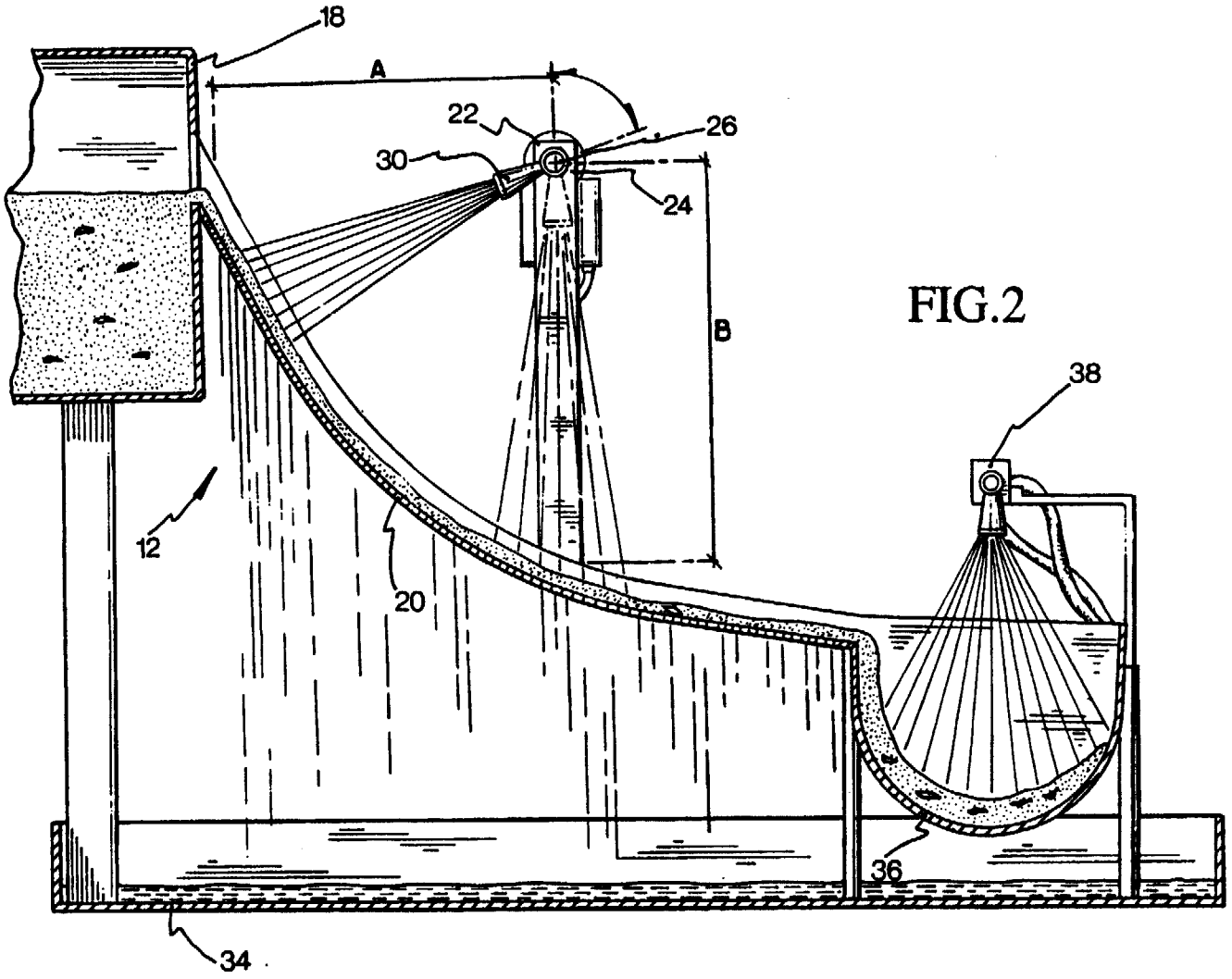
FIG. 2 is a cross-sectional view along lines 2—2 in FIG. 1.

FIGS. 1 to 5 illustrate an apparatus for classifying raw peat moss material in particulate form to extract fines and oversize particles therefrom. The refined product can then be used for manufacturing a peat moss board, according to any one of the processes disclosed in the previously referenced prior art. In a broad form, the peat moss material is suitable for making absorbent cores for disposable absorbent products.

The classifying apparatus, designated comprehensively by the reference numeral 10, comprises three main stations namely a primary screen 12 to extract fines from the peat moss material, a vibrating sieve 14 to remove oversize particles and a secondary screen 16 which removes residual fines.

The primary screen 12 comprises an overflow weir-type headbox 18 delivering an aqueous slurry of peat moss material on a gravity-type screen member 20 shaped as an arc of circle having an angular extent approaching 90°. The screen member 20 and the headbox 18 are commercially available products, manufactured by DORR-OLIVER INC., U.S.A.

The primary screen 12 also comprises a water spraying device 22 whose purpose is to rinse and agitate the solid peat moss particles in the slurry flowing on the screen member 20 to dislodge fines adhering thereto in order to eliminate a higher fraction of fines from the slurry, and to clear the screen openings that are being clogged by fines or particles having a fibrous identity. In addition to its cleansing action, the water spraying device 22 also adds dilution water to the slurry to maintain a high degree of fluidity which further enhances the fines removal process by providing enough dilutant to carry the fines through the screen member.

The water spraying device 22 includes a supporting frame 24 to which is rotatably mounted an elongated manifold 26 extending across the screen member 20. The manifold 26 is coupled to a drive unit 28 rotating the manifold 26 back and forth through an angular distance $\alpha$. On the manifold 26 are mounted in a spaced apart relationship spray heads 30 generating concentrated sprays formed of relatively large water drops directed at the screen member 20. The spray heads are constituted by nozzles generating a spray having a spread angle of 50° and capable to flow individually 7 gallons per minute at a pressure of 56 pound per square inch (psi). Such nozzles are commercially available from SPRAYING SYSTEMS CO., U.S.A.

The angular range $\alpha$ of the oscillating movement is selected whereby the sprays produced by the spray heads 30 sweep the majority of the surface of the screen member 20, by moving in a direction which is generally parallel to the direction of flow of the slurry on the screen member. In the example shown, $\alpha$ corresponds to an angle of 70°.

The distance at which the spray heads 30 are located with respect to the surface of the arcuate screen member 20 is a factor which determines the dimension of the water drops impacting against the screen member. Generally speaking, the size of the drops in the spray augments at an increasing distance from the source at the expense of a decrease in velocity. In the example shown, the spray heads 30 are horizontally spaced apart from the top edge of the screen member 20 by a distance of 41.5 inches (dimension A), and vertically spaced from the screen member by a distance of 47 inches (dimension B). When this arrangement is used with the type of nozzle mentioned earlier, supplied at 56 psi, drops of a size (at a point immediately before reaching the screen member 20) in the range from about 1200 to about 2500 microns are obtained. Water drops whose dimensions fall in this range have been found particularly advantageous for removing fines adhering to coarser particles in the slurry and for cleaning the screen member 20.

The spray heads are located closer to the screen member 20 when they are in a generally horizontal position, whereby the water spray impacting against the top portion of the screen member has a higher intensity to compensate for the higher velocity of the slurry at this point. The variable distance between the spray heads 30 and the screen surface provides in turn a variable intensity spray with variable size drops at different angular positions of the spray heads. This feature promotes a vigorous slurry agitation to enhance the removal of fines therefrom and to cleanse the screen openings.

A flexible water supply conduit 32 is coupled to the manifold 26 to establish a fluid path between the manifold and a source of water under pressure (not shown in the drawings).

Beneath the screen member 20 is provided a basin 34 for collecting fines and water passing through the screen member. The contents of the basin 34 are transferred on a continuous basis to a suitable location such as a storage tank for example, through a discharge outlet (not shown in the drawings) in the basin 34.

On the lower edge of the screen member 20 which forms the outlet of the primary screen 12 is mounted a channel 36 for collecting the screened slurry. Above the channel 36 is provided a slurry dilution system 38, delivering dilution water to the slurry in the channel to increase its fluidity.

The channel 36 conveys the screened slurry to the sieve 14 comprising a basin 40 in which is mounted a vibrating sieve member 42. The sieve member 42 retains oversize particles while the acceptable particles enter the basin 40 and are discharged therefrom through an outlet port 44.

The sieve member 42 has a central caved-in portion 46 define by converging inlet and outlet ramp surfaces 48 and 50 respectively. On the lower surface of the central portion 46 is mounted a vibrating mechanism 52 which causes the sieve member 42 to oscillate rapidly in a longitudinal direction to evenly spread on its surface slurry delivered by the channel 36 and to prevent the formation of flocs. The oscillatory movement also causes rejects to advance on the outlet ramp 50 which are discharged in a pit (not shown in the drawings). The basin 40 and the vibrating sieve element 42 are commercially available products, manufactured by the FULTON MANUFACTURING COMPANY, a division of ROSS PAPER MACHINERY CORPORATION, U.S.A.

The sieve 14 further comprises a rejects washing device 54 whose purpose is to wash rejects passing on the outlet ramp 50 to dislodge therefrom smaller peat moss particles adhering thereto, which are returned to the slurry and are allowed to pass through the sieve member 42. In this fashion, the raw peak moss material is utilized more efficiently because a lesser amount of acceptable particles are discarded with the rejects.

Figure 3:
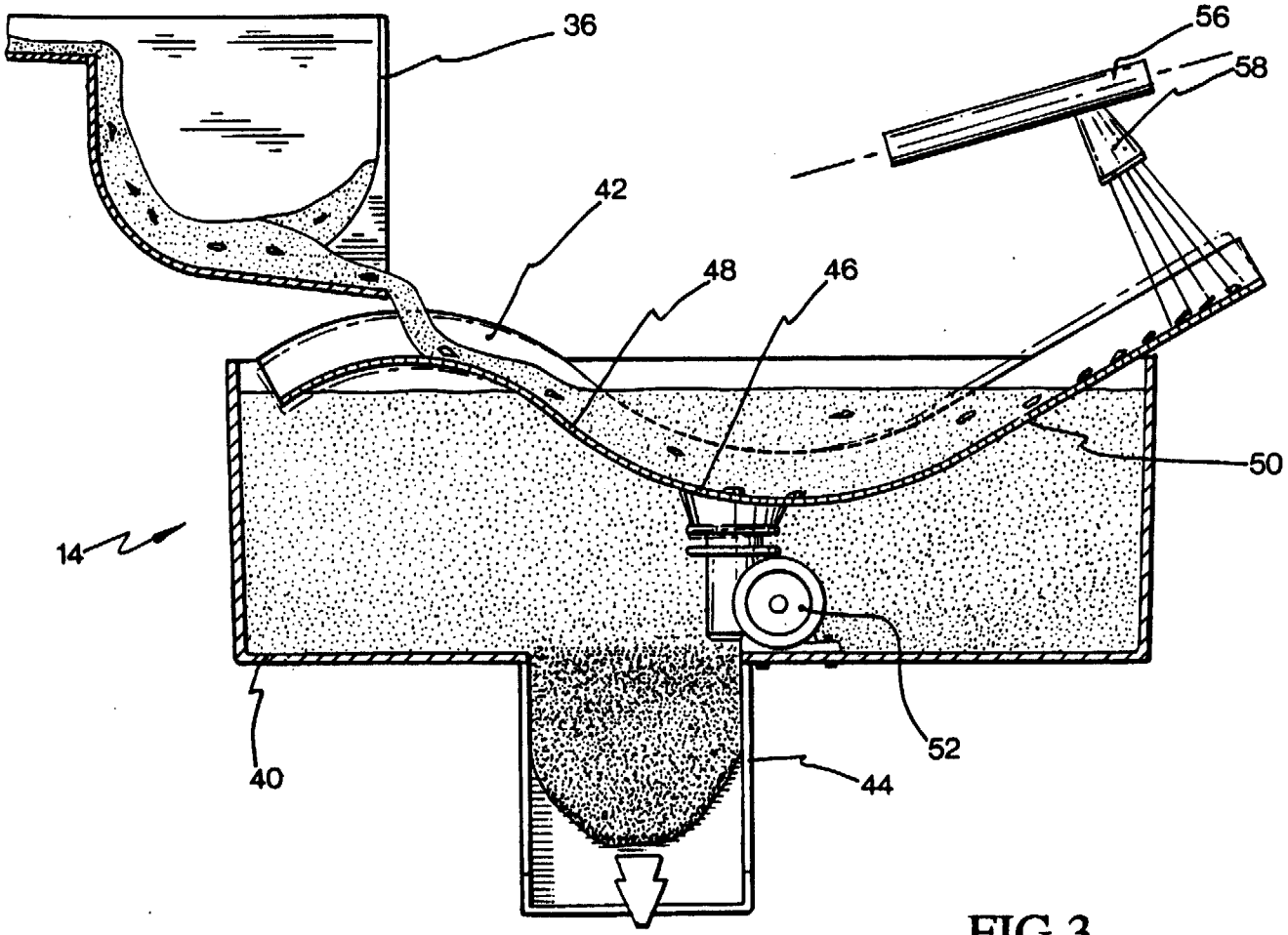
FIG. 3 is a cross-sectional view along lines 3—3 in FIG. 1.
Figure 4:
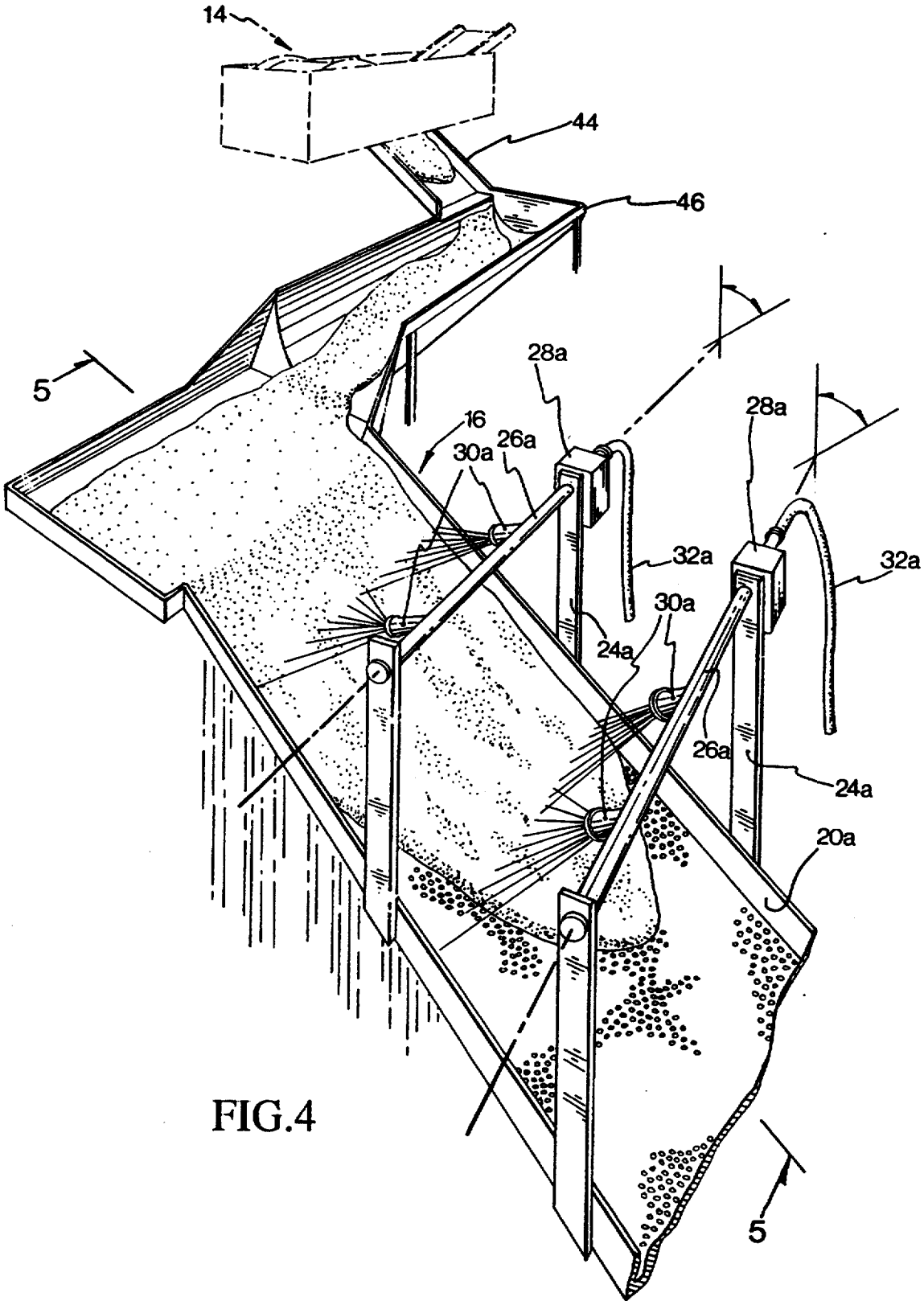
FIG. 4 is a schematical, perspective view of the third screening stage of the apparatus shown in FIG. 1.
Figure 5:
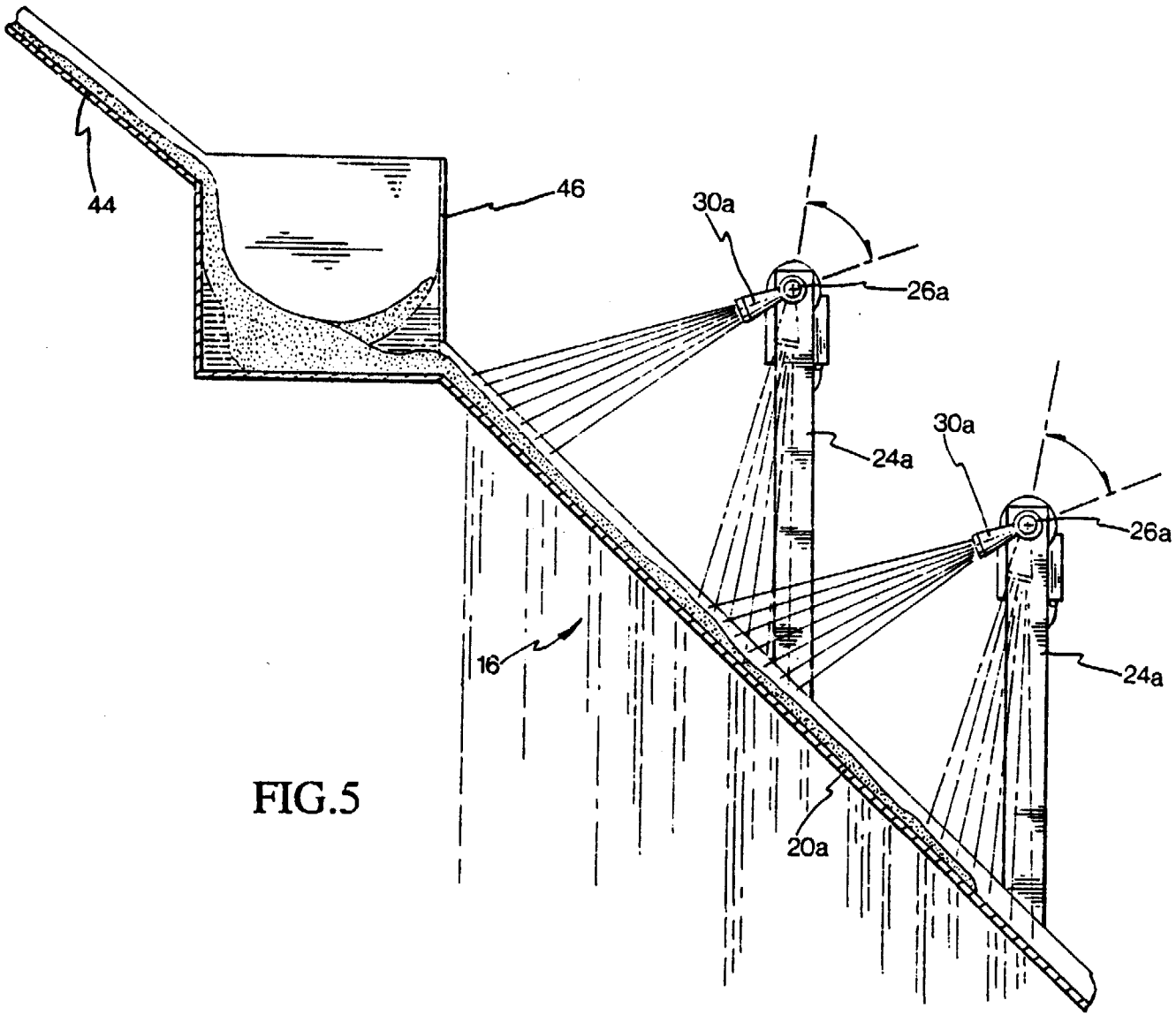
FIG. 5 is a cross sectional view taken along line 5—5 in FIG. 4.

The rejects washing device 54 is constructed in a similar fashion than the water spraying unit 22. More particularly, it comprises an oscillating manifold 56 (the drive mechanism is not shown in the drawings) rotating a spray head 58 back and forth along a direction perpendicular to the direction of movement of rejects on the outlet ramp 50. The angular range of movement of the manifold 56, designated $\beta$ in FIGS. 1 and 3, is considerably smaller than the angle $\alpha$.

The slurry passing through the sieve 14 is collected from the outlet 44 in a channel 46 similar in construction to the channel 36 except that no slurry dilution system is provided. The channel 46 delivers the slurry to the secondary screen 16 whose purpose is to eliminate from the slurry residual fines. The secondary screen 16 is identical in construction to the primary screen 12 except that the screen member is an inclined plane and two water spraying devices arranged in series are provided instead of one. A detailed description of the secondary screen 16 is not deemed to be necessary, however, for reference purposes, the various components of the screen 16 are identified with the same reference numerals used in conjunction with the screen 12, followed by the suffix "A".

The operation of the classification apparatus 10 is as follows. An aqueous slurry of peat moss material having a consistency in the range from about 0.4 to about 1.2% solids, more preferably of 0.80% is delivered to the headbox 18. The slurry is flowed on the screen member 20 which has a mesh size in the range from about 40 to about 100. In the example shown, the screen member 20 has a mesh size of 60. Fines in suspension in the slurry, having a dimension less than the screen member openings pass through the screen member 20 under the effect of gravity and accumulate in the basin 34 from where they are transferred to any appropriate location. Fines adhering to the coarser peat moss particles that remain on the screen are dislodged therefrom by the water spaying unit 22 which produces a spray of relatively large water drops impinging against the slurry to agitate the solid peat moss particles therein. In addition, the water spraying unit 22 also cleans the screen member 20 by projecting large water drops which create a forceful impact against the screen member 20 to continuously clear screen opening of fines or other minute particles obstructing them. The water spraying unit also supplies dilution water to the slurry to keep it at low consistency levels. Preferably, the water spraying unit 22 delivers in the range from about 18 to about 23.3 liters of water per minute per kilogram of bone dry material delivered on the screen member 20 per minute. More preferably, the flow-rate is set at 18 liters of water per minute per kilogram of bone dry material delivered on the screen member 20 per minute. A flow rate near the lower end of the range is preferred for practical reasons, permitting to use pumping equipment of a lesser capacity, for example.

The drive system 28 is set to oscillate the manifold 26 at approximately 24 cycles per minute, during each cycle the water sprays sweeping twice the entire surface of the screen member 20. The frequency of the oscillations is not critical and can be varied without departing from the spirit of the invention.

The slurry collected in the channel 36 from the primary screen 12 is diluted by regulating the flow rate of the slurry dilution system 38 to reach a consistency in the range from about 0.20 to about 0.75% solids. More preferably, the slurry is diluted to a consistency of 0.40% solids.

The diluted slurry is delivered to the sieve member 42 of the sieve 14 which has a mesh size in the range from about 8 to about 14. In the example shown, the sieve member 42 has a mesh size of 10.75. The rejects washing device 54 has a flow-rate in the range from about 7.44 to about 9.54 liters per minute per kilogram of bone dry material entering per minute the sieve 14. More preferably, the flow rate is set at 7.44 liters per minute per kilogram of bone dry material entering per minute the sieve 14. The rejects washing device 56 oscillates at approximately 11 cycles per minute.

The slurry collected in the channel 46 from the sieve 14 has a consistency in the range from about 0.18 to about 0.71% solids. More preferably, the consistency of the slurry is set at 0.38% solids. The slurry is delivered to the secondary screen 16 which has a mesh size in the range from about 40 to about 100 and more preferably of about 100. The water spraying unit 22A is operated at approximately 42 cycles per minute at a flow-rate in the range from about 23.3 to about 30.0 liters per minute per kilogram of bone dry material entering the secondary screen 16 per minute. More preferably, the flow-rate is set at 23.3 liters per minute per kilogram of bone dry material entering the secondary screen 16 per minute.

The water spraying units used in conjunction with the primary screen 12 and the sieve 14 are highly advantageous in that they allow to eliminate more completely the fines from the slurry and prevent large losses of acceptable particles when the slurry passes through the sieve 14. To illustrate the advantages of the invention, tests have been performed for measuring the particle size distribution of solids in the slurry at the first two screening stages of the apparatus 10 with the water spraying units active and inactive, The results are reported in the following tables.

TABLE I

| | (SCREEN 12) PERCENTAGE OF SOLID PARTICLES IN THE SLURRY | |
|---|---|---|
| PARTICLE SIZE (MESH) | WATER SPRAYING UNIT ACTIVE | WATER SPRAYING UNIT INACTIVE |
| >14 | 14.4 | 16.8 |
| >28 | 23.6 | 21.9 |
| >48 | 32.8 | 28.4 |
| >100 | 15.9 | 13.3 |
| >200 | 4.5 | 5.0 |
| <200 | 8.8 | 14.6 |

When the water spraying device 22 is active the screen 12 is capable of removing 47% more fines between 100 and 200 mesh than when the water spraying device is turned off.

TABLE II

| | (SIEVE 14) PERCENTAGE OF SOLID PARTICLES IN THE SLURRY | |
|---|---|---|
| PARTICLE SIZE (MESH) | WATER SPRAYING UNIT ACTIVE | WATER SPRAYING UNIT INACTIVE |
| >14 | 55.3 | 49.1 |
| >28 | 18.3 | 20.7 |
| >48 | 18.5 | 20.1 |
| >100 | 7.9 | 7.9 |
| >200 | 1.8 | 2.0 |

When the water spraying device 54 is inactive, 9% more particles between 28 and 100 mesh (particles that are not intended to be eliminated) are removed than when the water spraying device is active.

The scope of the present invention is not limited by the description, examples and suggestive uses herein, as modifications can be made without departing from the spirit of the invention. Application of the product and the methods of the present invention for sanitary and other health-care uses can be accomplished by any sanitary protection, incontinence, medical and absorbent methods and techniques as are presently or prospectively known to those skilled in the art. Thus, it is intended that the present application covers the modifications and variations of this invention provided that they come within the scope of the appended claims and their equivalents.

We claim:

1. A method for screening peat moss material in particulate form, comprising the steps of:

forming a slurry of peat moss material having a pumpable consistency;

depositing said slurry on a screen to separate fines from coarser particles in said slurry by straining action;

directing a spray of water drops at said slurry while said slurry is on said screen and moving said spray to agitate said coarser particles in order to:

i) agitate said coarser particles to dislodge fines adhered thereto, whereby fines freed from said coarser particles are allowed to egress said slurry through said screen; and ii) clear openings of said screen clogged by fines.

2. A method as defined in claim 1, wherein said spray of water has a velocity and said velocity of said water drops is varied as said spray is moved over said screen.

3. A method as defined in claim 1, wherein said spray of water drops has an average size and said size is varied as said spray is moved over said screen.

4. A method as defined in claim 1, comprising the step of increasing a velocity of said water drops when said spray moves toward a slurry inlet region of said screen.

5. A method as defined in claim 1, wherein said spray has a source and said source is moved with respect to said screen, and wherein said source and said screen are spaced a distance apart and said distance between said source and said screen is varied.

6. A method as defined in claim 1, comprising the step of moving said spray of water drops in a direction generally parallel to a direction of flow of said slurry on said screen.

7. A method as defined in claim 1, comprising the step of oscillating said spray of water drops over said screen.

8. A method as defined in claim 1, wherein said water drops when impinging on said screen have a size in the range from about 1200 to about 2500 microns.

9. A method as defined in claim 1, wherein said spray of water drops has a flow-rate in the range from about 18 to about 23.3 liters per minute per kilogram of bone dry solid material in said slurry entering said screen per minute.

10. A method as defined in claim 1, wherein said spray of water drops has a flow-rate of approximately 18 liters per minute per kilogram of bone dry solid material in said slurry entering said screen per minute.

11. A method as defined in claim 1, wherein said slurry has at an entry point on said screen a consistency in the range from about 0.40 to about 1.20% solids.

12. A method as defined in claim 1, wherein said slurry has at an entry point on said screen a consistency of approximately 0.80% solids.

13. A method as defined in claim 1, wherein said screen has a mesh size in the range from about 40 to about 100.

14. A method as defined in claim 1, wherein said screen has a mesh size of approximately 60.

15. A method as defined in claim 1, further comprising the steps of:

collecting said slurry from an outlet of said screen; and transferring said slurry to a sieve to remove from said slurry excessively large particles having a size exceeding a predetermined value.

16. A method as defined in claim 15, further comprising the step of directing a spray of water drops at rejects retained by said sieve in order to dislodge from said rejects smaller particles adhering thereto and having a size below said predetermined value, whereby smaller particles freed from said rejects are returned in suspension in said slurry and allowed to pass through said sieve.

17. A method as defined in claim 16, further comprising the step of moving said spray of water drops over said sieve.

18. A method as defined in claim 17, comprising the step of moving said spray of water drops in a direction generally perpendicular to a direction of movements of said rejects on said sieve.

19. A method as defined in claim 17, comprising the step of oscillating said spray of water drops over said sieve.

20. A method as defined in claim 15, comprising the step of vibrating said sieve.

21. A method as defined in claim 15, comprising the step of:

collecting said slurry from an outlet of said sieve; and transferring said slurry to a secondary screen to remove residual fines therefrom.

22. A method as defined in claim 21, comprising the step of directing a spray of relatively large water drops to said slurry while said slurry is on said secondary screen.

23. A method for classifying peat moss material in particulate form, said method comprising the steps of:

forming an aqueous slurry of peat moss material having a consistency in the range from about 0.40 to about 1.20% solids;

flowing said slurry over a screen having a mesh size in the range from about 40 to about 100 in order to separate fines from coarser particles in said slurry by straining action;

directing at said slurry a spray of water drops while said slurry is on said screen to:

i) agitate said coarser particles to dislodge fines adhered thereto, whereby fines freed from said coarser particles are allowed to egress said slurry through said screen; and ii) clear openings of said screen clogged by fines, collecting said slurry from an outlet of said screen;

flowing said slurry over a sieve having a mesh size from about 8 to about 14 to eliminate from said slurry oversize particles having a dimension in excess of a predetermined value;

washing rejects blocked by said sieve with a spray of water drops to dislodge from said rejects acceptable particles adhering to said rejects and having a size such that said acceptable particles are capable of passing through said sieve, whereby acceptable particles freed from said rejects are returned in suspension in said slurry and are allowed to pass through said sieve.

24. A method for screening peat moss material, comprising the steps of:

forming a slurry of peat moss material having a pumpable consistency;

depositing said slurry on a sieve to eliminate from said slurry particles larger than a predetermined acceptable dimension;

directing a spray of water drops at said slurry while said slurry is on said sieve and moving said spray in order to dislodge from rejects blocked by said sieve acceptable particles adhering to said rejects and having a size less than said predetermined acceptable dimension, whereby acceptable particles freed from said rejects are returned in suspension in said slurry and are allowed to pass through said sieve.

25. An apparatus for screening peat moss material, comprising:

a screen having a predetermined mesh size;

a supply conduit for delivering to said screen a slurry of peat moss material having a pumpable consistency, wherein said screen allows to separate fines from coarser particles in said slurry by straining action;

a spray head in fluid communication with a pressurized supply of water for generating a spray of water directed at said slurry while said slurry is on said screen to:

i) agitate said coarser particles to dislodge fines adhered thereto, whereby fines freed from said coarser particles are allowed to egress said slurry through said screen; and ii) clear openings of said screen clogged by fines, wherein said spray head is movable in order to displace said fluid spray over said screen to reach different sections thereof.

* * * * *